US006530752B2

(12) United States Patent
Oba et al.

(10) Patent No.: US 6,530,752 B2
(45) Date of Patent: Mar. 11, 2003

(54) VARIABLE DISPLACEMENT PUMP

(75) Inventors: Kenzo Oba, Tochigi (JP); Katsuyuki Yoshida, Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/835,662

(22) Filed: Apr. 16, 2001

(65) Prior Publication Data

US 2001/0031204 A1 Oct. 18, 2001

(30) Foreign Application Priority Data

Apr. 18, 2000 (JP) ..... 2000-117091

(51) Int. Cl.[7] ..... F04B 49/00

(52) U.S. Cl. ..... 417/220; 417/283; 417/310; 418/30

(58) Field of Search ..... 417/220, 310, 417/311, 213, 283; 418/30, 24, 25, 26, 27

(56) References Cited

U.S. PATENT DOCUMENTS

| | | | | |
|---|---|---|---|---|
| 2,755,741 A | | 7/1956 | Erskine | 103/42 |
| 2,880,674 A | | 4/1959 | Klessig et al. | 103/42 |
| 4,099,893 A | * | 7/1978 | Coffman | 417/300 |
| 5,490,770 A | * | 2/1996 | Oogushi | 418/27 |
| 5,515,879 A | | 5/1996 | Mollo | 137/115 |
| 5,518,380 A | * | 5/1996 | Fujii et al. | 418/26 |
| 5,538,400 A | * | 7/1996 | Konishi et al. | 417/220 |
| 5,562,432 A | * | 10/1996 | Semba et al. | 418/26 |
| 6,155,797 A | * | 12/2000 | Kazuyoshi | 417/220 |
| 6,217,296 B1 | * | 4/2001 | Miyazawa et al. | 417/310 |

FOREIGN PATENT DOCUMENTS

| | | |
|---|---|---|
| DE | 4112196 A1 | 10/1992 |
| DE | 19832719 A1 | 1/2000 |
| JP | 8200239 | 8/1996 |

* cited by examiner

*Primary Examiner*—Charles G. Freay
*Assistant Examiner*—Han L. Liu
(74) *Attorney, Agent, or Firm*—Orum & Roth

(57) ABSTRACT

In a variable displacement pump, a relief valve is constituted by a pilot drive type relief valve obtained by adding a pilot valve to a main valve, a fluid pressure in a downstream side of a metering orifice provided in a pump discharge side passage is applied to the pilot valve, and the main valve is capable of opening and closing a downstream side passage of the metering orifice with respect to a drain passage.

16 Claims, 5 Drawing Sheets

VARIABLE DISPLACEMENT PUMP

BACKGROUND OF THE INVENTION

1. Field of the Invention

The present invention relates to a variable displacement pump used in a power steering apparatus for a motor vehicle or the like.

2. Description of the Related Art

Conventionally, in order to assist a steering force by a hydraulic power steering apparatus for a motor vehicle, a variable displacement pump described in Japanese Patent Application Laid-Open (JP-A) No. 8-200239 is used. This conventional variable displacement pump is directly rotated and driven by an engine of the motor vehicle. The variable displacement pump has a rotor within a cam ring moveably and displaceably fitted to an adapter ring fitting to a pump casing, thereby forming a pump chamber between the cam ring and the outer peripheral portion of the rotor.

In this conventional art, the cam ring is structured to be movable and displaceable within the adapter ring. An urging force maximizing the capacity of the pump chamber is applied to the cam ring by a spring. The first and second fluid pressure chambers are separately formed between the cam ring and the adapter ring. A switch valve controls the fluid pressure supplied to both of the fluid pressure chambers. This corresponds with the amount of discharge flow of a pressurized fluid from the pump chamber so as to move the cam ring. The capacity of the pump chamber is changed so as to control the discharge flow amount from the pump chamber. Accordingly, in this variable displacement pump, the amount of discharge flow is controlled to be large so as to obtain a large steering assist force when the motor vehicle stops or runs at a low speed, where the motor vehicle has a low rotational speed. The discharge flow amount is controlled to be equal to or less than a fixed amount, making the steering assist force small when the motor vehicle runs at a high speed, where the motor vehicle has a high rotational speed, whereby it is able to generate the steering assist force required for the power steering apparatus.

In the conventional art, a direct-drive type relief valve is provided in a pump discharge side passage so as to relieve the fluid pressure when the fluid pressure in the pump discharge side becomes too large due to a static turn steering state in the power steering apparatus being maintained or the like.

Since the relief valve placed in the pump discharge side passage in the conventional art is the direct-drive type, a change of relief pressure in accordance with a passing flow amount (a pressure override characteristic) is large. The passing flow amount tends to increase in accordance with an increase in the rotational speed, and reduce due to a reduction of an oil temperature. Accordingly, in a variable displacement pump with a direct-drive type relief valve in accordance with the conventional art, the used rotational speed and the oil temperature change affect it, making it impossible to obtain an inherently required relief pressure.

SUMMARY OF THE INVENTION

An object of the present invention is to make it possible to set a stable relief pressure even when using conditions (a rotational speed and an oil temperature) are changed, when relieving an excessive fluid pressure in a pump discharge side, in a variable displacement pump.

In accordance with the present invention, there is a variable displacement pump comprised of a rotor rotated and driven while fixed to a pump shaft inserted to a pump casing and receiving a multiplicity of vanes in a groove so as to be movable in a radial direction. It contains an adapter ring fitted to a fitting hole in the pump casing and a cam ring fitted to the adapter ring so as to form a pump chamber between the cam ring and an outer peripheral portion of the rotor. The cam ring is movable and displaceable within the adapter ring and separately forms the first and second fluid pressure chambers between the cam ring and the adapter ring. A switch valve operated due to a pressure difference between an upstream side and a downstream side in a metering orifice provided in the pump discharge side passage controls the supply of fluid pressure to the first and second fluid pressure chambers in correspondence to a discharge flow amount of a pressurized fluid discharged from the pump chamber. This moves the cam ring and changes the capacity of the pump chamber, thereby making it possible to control the discharge flow amount discharged from the pump chamber. A relief valve relieves the excessive fluid pressure in the pump discharge side. The relief valve is constituted by a pilot drive type relief valve obtained by adding a pilot valve to a main valve. The fluid pressure in the downstream side of the metering orifice provided in the pump discharge side passage is applied to the pilot valve, and the main valve is capable of opening and closing the downstream side passage of the metering orifice with respect to a drain passage.

In accordance with the present invention, there is a variable displacement pump comprising a rotor rotated and driven while fixed to a pump shaft inserted to a pump casing and receiving a multiplicity of vanes in a groove so as to be movable in a radial direction.

It contains an adapter ring fitted to a fitting hole in the pump casing and a cam ring fitted to the adapter ring so as to form a pump, chamber between the cam ring and an outer peripheral portion of the rotor. The cam ring is movable and displaceable within the adapter ring and separately forms the first and second fluid pressure chambers between the cam ring and the adapter ring. A switch valve operated due to a pressure difference between an upstream side and a downstream side in a metering orifice provided in a pump discharge side passage controls the supply of fluid pressure to the first and second fluid pressure chambers in correspondence to a discharge flow amount of a pressurized fluid discharged from the pump chamber. This moves the cam ring and changes the capacity of the pump chamber, thereby making it possible to control the discharge flow amount discharged from the pump chamber. A relief valve relieves the excessive fluid pressure in the pump discharge side. The relief valve is constituted by a pilot drive type relief valve obtained by adding a pilot valve to a main valve. The fluid pressure in the upstream side, of the metering orifice provided in the pump discharge side passage is applied to the pilot valve, and the main valve is capable of opening and closing the upstream side passage of the metering orifice with respect to a drain passage.

BRIEF DESCRIPTION OF THE DRAWINGS

The present invention will be more fully understood from the detailed description given below and from the accompanying drawings which should not be taken to be a limitation on the invention, but are for explanation and understanding only. The drawings

DESCRIPTION OF THE PREFERRED EMBODIMENTS

First Embodiment FIGS. 1 to 5

Figure 1:
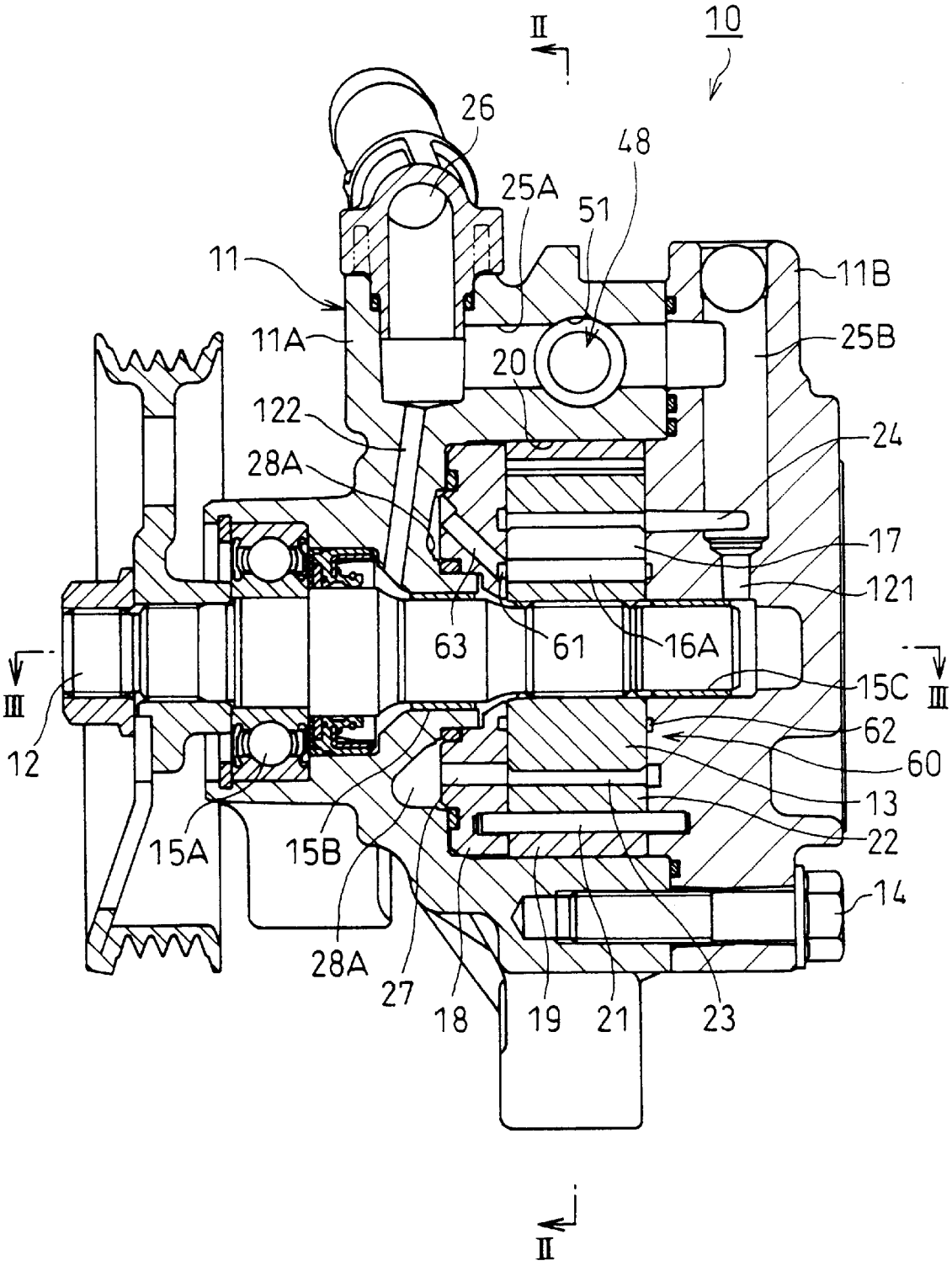
FIG. 1 is a cross sectional view showing a variable displacement pump.
Figure 2:
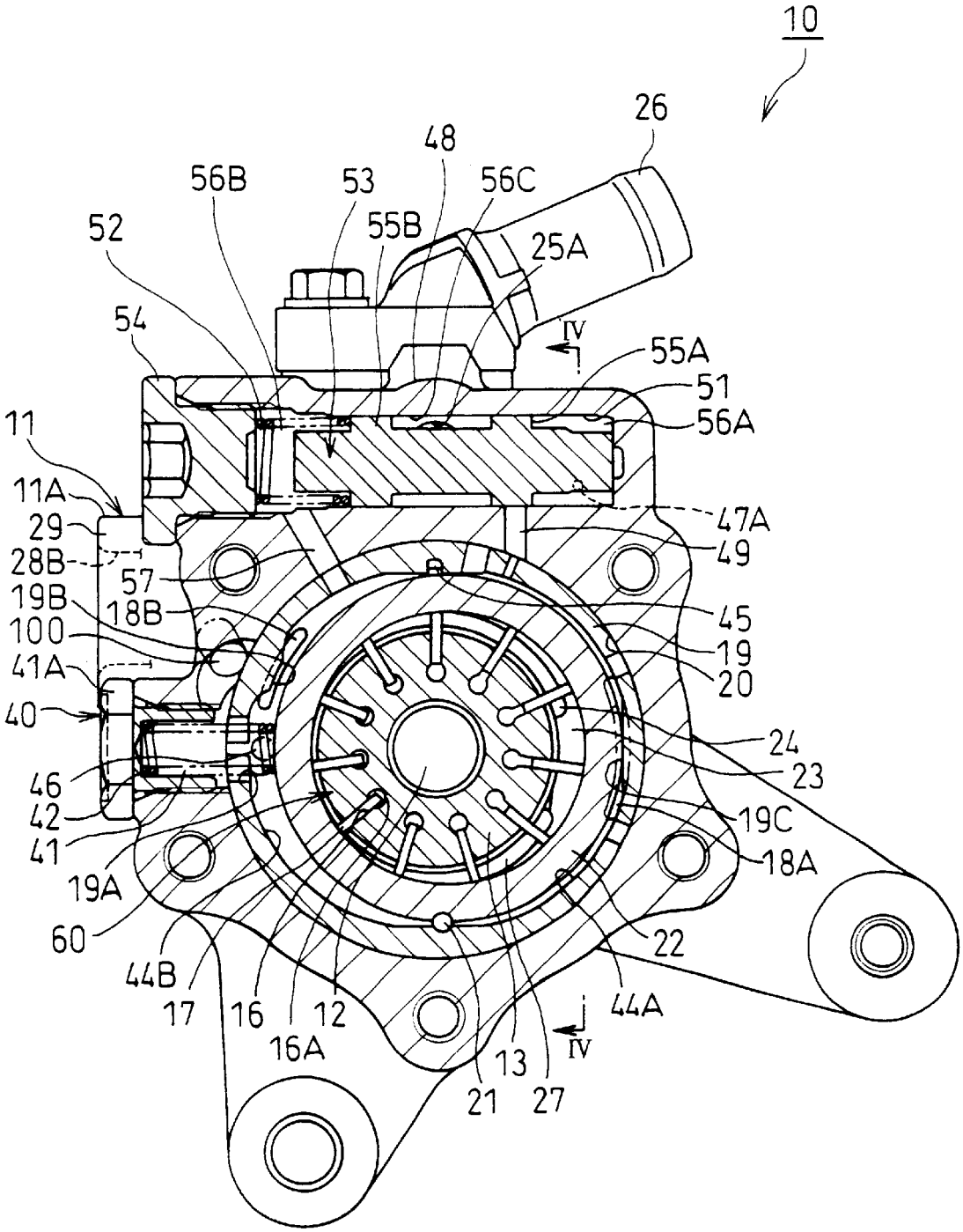
FIG. 2 is a cross sectional view along a line II—II in FIG. 1.
Figure 3:
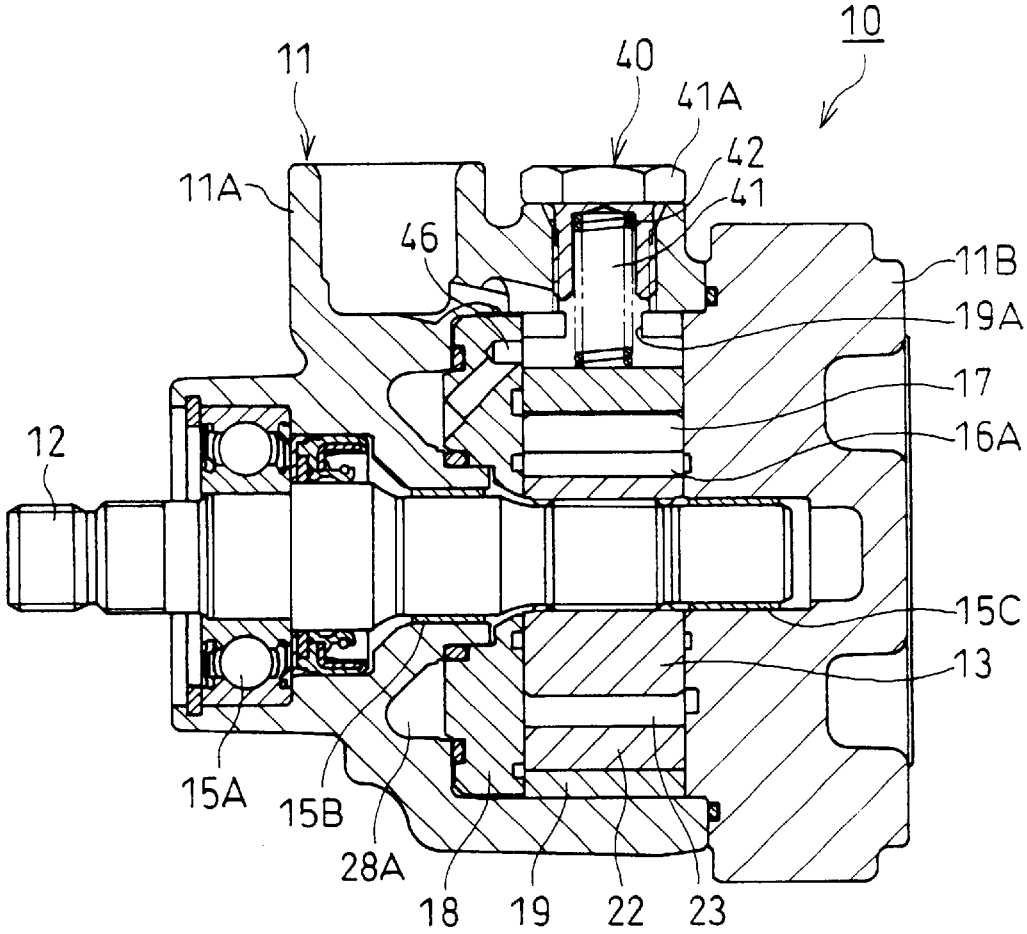
FIG. 3 is a cross sectional view along a line III—III in FIG. 1.
Figure 4:
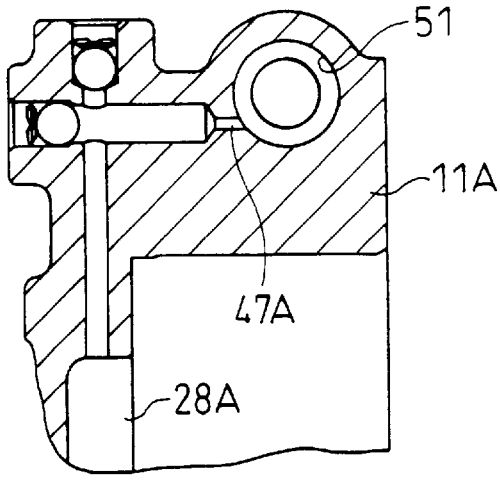
FIG. 4 is a cross sectional view along a line IV—IV in FIG. 2.

A variable displacement pump 10 is a vane pump corresponding to an oil pressure generating source of a hydraulic power steering apparatus for a motor vehicle. The pump 10 has a rotor 13 fixed in accordance with a serration to a pump shaft 12 inserted to a pump casing 11 so as to be rotated and driven as shown in FIG. 1 to FIG. 3. The pump casing 11 is structured by integrally combining a pump housing 11A with a cover 11B by using a bolt 14, and supports the pump shaft 12 via bearings 15A to 15C. The pump shaft 12 can be directly rotated and driven by an engine of a motor vehicle.

The rotor 13 is structured such that vanes 17 are received in grooves 16 respectively provided at a multiple positions in a peripheral direction and the respective vanes 17 can be moved in a radial direction along the grooves 16.

A pressure plate 18 and an adapter ring 19 are fitted in a laminated state to a fitting hole 20 in the pump housing 11A of the pump casing 11. These elements are fixed and held from a side portion by the cover 11B, in a state of being positioned in a peripheral direction by the supporting point pin 21 mentioned below. One end of 10 the supporting point pin 21 is fitted and fixed to the cover 11B.

A cam ring 22 is fitted to the above mentioned adapter ring 19 fitting to the pump housing 11A of the pump casing 11. The cam ring 22 surrounds the rotor 13 with an eccentricity with respect to the rotor 13. This forms a pump chamber 23 between the cam ring 22 and an outer peripheral portion of the rotor 13, between the pressure plate 18 and the cover 1B. In a suction area on an upstream side in a rotor rotational direction of the pump chamber 23, a suction port 24 provided in the cover 11B is opened. A suction port 26 of the pump 10 is communicated with the suction port 24 via suction passages 25A and 25B provided in the housing 11A and the cover 11B. On the contrary, a discharge port 27 provided in the pressure plate 18 is opened to a discharge area in a downstream side in the rotor rotational direction of the pump chamber 23, and a discharge port 29 of the pump 10 is communicated with the discharge port 27 via a high pressure chamber 28A and a discharge passage 28B provided in the housing 11A.

In the variable displacement pump 10, when the rotor 13 is rotated and driven by the pump shaft 12, and the vane 17 of the rotor 13 rotates by being pressed to the cam ring 22 by the centrifugal force, the followings occur. In the upstream side in the rotor rotational direction of the pump chamber 23, the variable displacement pump 10 expands a capacity surrounded by the adjacent vanes 17 and the cam ring 22 together with the rotation so as to suck a working fluid from the suction port 24. In the downstream side in the rotor rotational direction of the pump chamber 23, the variable displacement pump 10 reduces the capacity surrounded by the adjacent vanes 17 and the cam ring 22 together with the rotation so as to discharge the working fluid from the discharge port 27.

The variable displacement pump 10 has a discharge flow amount control apparatus 40 structured in the following manner (A) and a vane pressurizing apparatus 60 structured in the following manner (B).

(A) Discharge Flow Amount Control Apparatus 40

The discharge flow amount control apparatus 40 is structured such that the supporting point pin 21 is mounted vertically on the lowermost portion of the adapter ring 19 fixed to the pump casing 11. The lowest vertical portion of the cam ring 22 is supported by the supporting point pin 21, and the cam ring 22 can be swingably displaced within the adapter ring 19.

The discharge flow amount control apparatus 40 can apply an urging force maximizing the capacity of the pump chamber 23 to the cam ring 22. This occurs when a spring 42 is received in the spring chamber 41 provided in the pump housing 11A constituting the pump casing 11 through a spring hole 19A provided in the adapter ring 19, so as to be in pressure contact with an outer peripheral portion of the cam ring 22. The spring 42 is backed up by a cap 41A attached to an opening portion of the spring chamber 41. In this case, the adapter ring 19 is structured such that a cam ring movement restricting stopper 19B is formed in a protruding shape in a part of an inner peripheral portion forming a second fluid pressure chamber 44B, whereby it is possible to restrict a moving limit of the cam ring 22 to minimize the capacity of the pump chamber 23 as mentioned below. The adapter ring 19 is structured such that a cam ring movement restricting stopper. 19C is formed in a protruding shape in a part of an inner peripheral portion forming a first fluid pressure chamber 44A so as to restrict a moving limit of the cam ring 22 to maximize the capacity of the pump chamber 23.

The discharge flow amount control apparatus 40 separately forms the first and second fluid pressure chambers 44A and 44B between the cam ring 22 and the adapter ring 19. The first fluid pressure chamber 44A and the second fluid pressure chamber 44B are separated between the cam ring 22 and the adapter 19 by the supporting point pin 21 and a seal member 45 provided at an axially symmetrical position. At this time, the first and second fluid pressure chambers 44A and 44B are sectioned both side portions between the cam ring 22 and the adapter ring 19 by the cover 11B and the pressure plate 18. The pressure plate 18 has a communicating groove 18A communicating the first fluid pressure chambers 44A separated into both sides of the stopper 19C with each other, and a communicating groove 18B communicating the second fluid pressure chambers 44B separated into both sides of the stopper 19B with each other, when the cam ring 22 collides and aligns with the cam ring movement restricting stoppers 19B and 19C in the adapter ring 19.

In the discharge path of the pump 10 mentioned above, the pressure fluid discharged from the pump chamber 23 and fed out to the high pressure chamber 28A of the pump housing 11A from the discharge port 27 of the pressure plate 18 is fed to the discharge passage 28B from a metering orifice 46 pieced in the pressure plate 18 via the second fluid pressure chamber 44B mentioned above, the spring chamber 41 mentioned above passing through the adapter ring 19 and a discharge communicating hole 100 notched in the fitting hole 20 of the pump housing 11A.

The discharge flow amount control apparatus 40 increases and reduces an opening area of the metering orifice 46 open to the second fluid pressure chamber 44B by the side wall of the cam ring 22, in the discharge path of the pump 10 mentioned above, thereby forming a variable metering orifice. The opening degree of the orifice 46 is adjusted by the side wall in correspondence to the moving displacement of the cam ring 22. The discharge flow amount control apparatus 40 (1) then introduces the high fluid pressure of the high pressure chamber 28A before passing through the orifice 46 to the first fluid pressure chamber 44A via a first fluid pressure supply passage 47A (FIG. 4), a switch valve apparatus 48, the pump housing 11A and a communicating passage 49 pierced in the adapter 19, and (2) introduces the reduced pressure after passing through the orifice 46 to the second fluid pressure chamber 44B in the manner mentioned above. The cam ring 22 moves against the urging force of the spring 42 mentioned above due to the differential force of the pressure applied to both of the fluid pressure chambers 44A and 44B, and changes the capacity of the pump chamber 23, thereby capable of controlling the discharge flow amount of the pump 10.

The switch valve apparatus 48 is structured such that a spring 52 and a switch valve 53 are received in a valve receiving hole 51 pierced in the pump housing 11A, and the switch valve 53 urged by the spring 52 is supported by a cap 54 engaged with the pump housing 11A. The switch valve 53 has a switch valve body 55A and a valve body 55B, and is structured such that the first fluid pressure supply passage 47A is communicated with a pressurizing chamber 56A in the switch valve body 55A. The second fluid pressure chamber 44B is communicated with a back pressure chamber 56B in which another spring 52 of the valve body 55B is stored, via the pump housing 11A and a communicating passage 57 pieced in the adapter ring 19. A suction passage (a drain passage) 25A mentioned above is formed through a manner in a middle chamber 56C between the switch valve body 55A and the valve body 55B, and is communicated with a tank. The switch valve body 55A can open and close the pump housing 11A and the communicating passage 49 mentioned above pierced in the adapter ring 19. In a low rotational range with a low discharge pressure of the pump 10, the switch valve body 55A sets the switch valve 53 to an original position shown in FIG. 2 due to the urging force of the spring 52. This closes the communicating passage 49 to the first fluid pressure chamber 44A by the switch valve body 55A. In a middle and high rotational range of the pump 10, the switch valve body 55A moves the switch valve 53 due to the high pressure fluid applied to the pressurizing chamber 56A so as to open the communicating passage 49, thereby introducing the high pressure fluid to the first fluid pressure chamber 44A.

Accordingly, a discharge flow amount characteristic of the pump 10 provided with the discharge flow amount control apparatus 40 is as follows.

(1) In a low speed running range of a motor vehicle in which the rotational speed of the pump 10 is low, the pressure of the fluid discharged from the pump chamber 23 to the pressurizing chamber 56A of the switch valve apparatus 48 is still low. Thus, the switch valve 53 is positioned at the original position and the cam ring 22 maintains the original state urged by the spring 42. Accordingly, the discharge flow amount of the pump 10 is increased in proportion to the rotational speed.

(2) When the pressure of the fluid discharged from the pump chamber 23 to the pressurizing chamber 56A of the switch valve apparatus 48 becomes high due to an increase of the rotational speed of the pump 10, the switch valve apparatus 48 moves the switch valve 53 against the urging force of the spring 52 so as to open the communicating passage 49 and introduce the high pressure fluid to the first fluid pressure chamber 44A. The cam ring 22 moves due to the differential pressure applied to the first fluid pressure chamber 44A and the second fluid pressure chamber 44B so as to gradually reduce the capacity of the pump chamber 23. The discharge flow amount of the pump 10 can cancel the flow amount increase caused by the increase of the rotational speed and the flow amount reduction caused by the reduction of the capacity in the pump chamber 23 with respect to the increase of the rotational speed, so as to maintain a fixed large flow amount.

(3) When the rotational speed of the pump 10 is continuously increased more and the cam ring 22 is further moved, whereby the cam ring 22 presses the spring 42 at over a fixed amount, the side wall of the cam ring 22 starts throttling an open area of the orifice 46 in the middle portion of the discharge path from the pump chamber 23. Accordingly, the discharge flow amount pressure fed to the discharge passage 28B of the pump 10 is reduced in proportion to the throttling amount of the orifice 46.

(4) When reaching a high speed drive range of the motor vehicle in which the rotational speed of the pump 10 is over a fixed value, the cam ring 22 reaches a moving limit where the cam ring 22 collides and aligns with the stopper 19B of the adapter ring 19. The throttling amount of the orifice 46 generated by the side wall of the cam ring 22 becomes maximum, and the discharge flow amount of the pump 10 maintains a fixed small flow amount.

In the discharge flow amount control apparatus 40, the throttle 49A provided in the communicating passage 49 communicates with the pressurizing chamber 56A of the switch valve apparatus 48 with the first fluid pressure chamber 44A. The throttle 57A in the communicating passage 57 communicates the second fluid pressure chamber 44B with the back pressure chamber 56B of the switch valve apparatus 48.

(B) Vane Pressurizing Apparatus 60

The vane pressurizing apparatus 60 has ring-shaped oil grooves 61 and 62 on slidable contact surfaces of the pressure plate 18 and the side plate 20 with the groove 16, corresponding to both sides of the base portion 16A of the groove 16 receiving the vane 17 of the rotor 13. The high pressure chamber 28A of the pump chamber 23 in the pump housing 11A communicates with the oil groove 61 mentioned above via an oil hole 63 in the pressure plate 18. The pressure fluid discharged from the pump chamber 23 to the high pressure chamber 28A can be introduced to the base portion of the groove 16 for all the vanes 17 in the peripheral direction of the rotor 13 via the oil grooves 61 and 62 of the pressure plate 18 and the side plate 20, and can pressurize each of the vanes 17 toward the cam ring 22.

The pump 10 presses the vane 17 to the cam ring 22 due to a centrifugal force at when beginning rotation. However, after the discharge pressure is generated, the pump 10 increases the contact pressure between the vane 17 and the cam ring 22 by the vane pressurizing apparatus 60, thereby capable of preventing the pressure fluid from inversely flowing.

The pump 10 has a relief valve 70 which relieves the excessive fluid pressure in the pump discharge side between the high pressure chamber 28A and the suction passage (the drain passage) 25A. In the pump 10, a lubricating oil supply passage 121 from the suction passage 25B toward the bearing 15C of the pump shaft 12 is pierced in the cover 11B. A lubricating oil return passage 122 returning from a peripheral portion of the bearing 15B of the pump shaft 12 to the suction passage 25A is pieced in the pump housing 11A.

Figure 5:
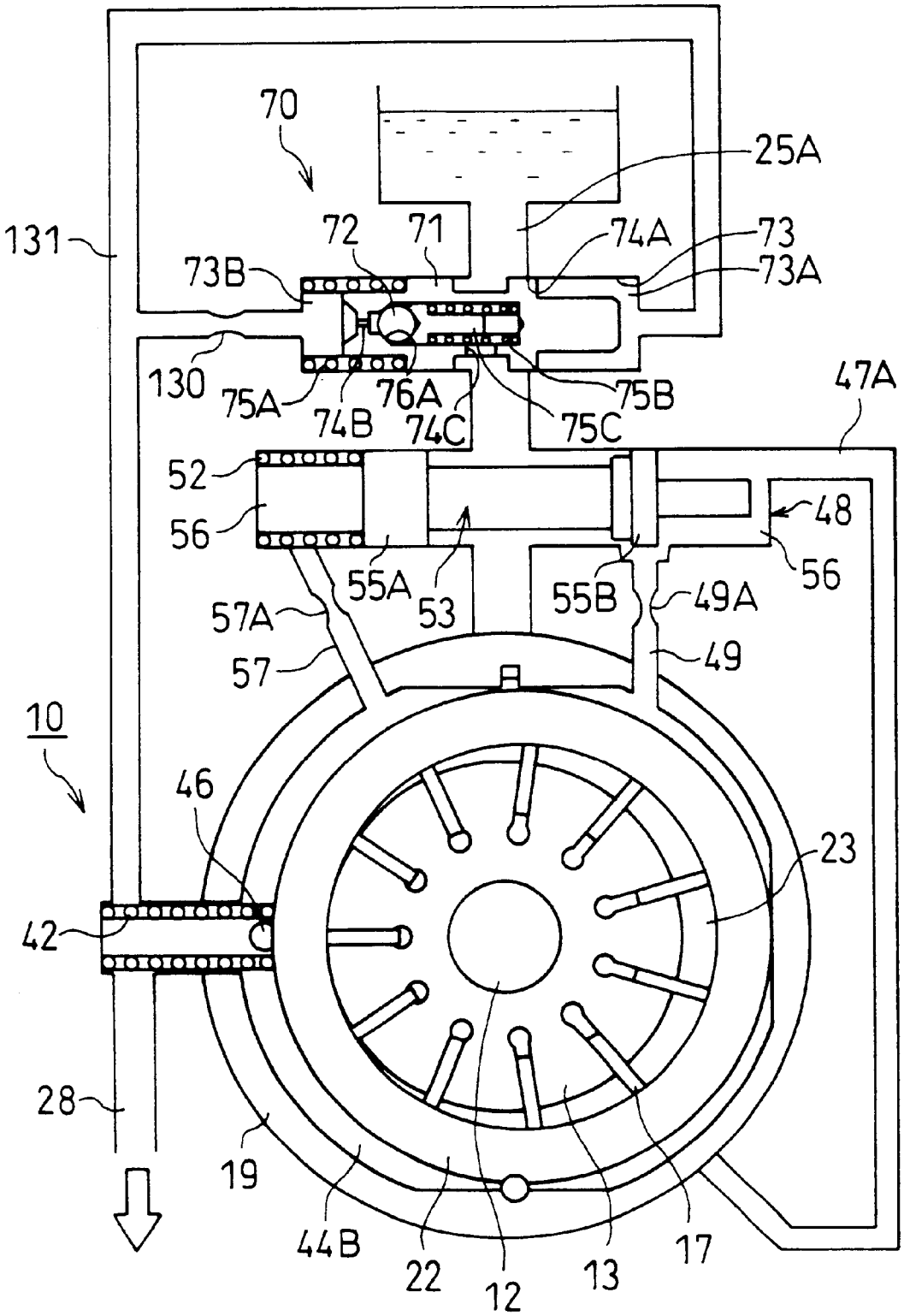
FIG. 5 is a hydraulic circuit view of a variable displacement pump.

In the pump 10, the relief valve 70 is structured as shown in FIG. 5.

The relief valve 70 is structured in a pilot-drive type in which a pilot valve 72 is added to a main valve 71. The main valve 71 can open and close a downstream side passage of the metering orifice 46 provided in the pump discharge side passage, that is, a first valve chamber 73A with respect to the drain passage 25A. A fluid pressure in the downstream side of the metering orifice 46provided in the pump discharge side passage, and a fluid pressure of the second valve chamber 73B is applied to the pilot valve 72. At this time, the fluid pressure in the downstream side of the metering orifice 46 is applied to the pilot valve 72 via a throttle 130. Then, the relief valve 70 shown in FIG. 5 has the following structures (a) to (c).

(a) The relief valve 70 has the main valve 71 slidably within the valve chamber 73, and applies the fluid pressure in the downstream side of the metering orifice 46 provided in the discharge side passage of the pump 10 to the first valve chamber 73A. The first valve chamber 73A is defined in one end side of the valve chamber 73 with respect to the main valve 71 via a passage 131. The relief valve 70 applies the fluid pressure in the downstream side of the metering orifice 46 to the second valve chamber 73B defined in another end side of the valve chamber 73 with respect to the main valve 71 via the passage 131 (the throttle 130). The relief valve 70 has a first relief passage 74A communicating the first valve chamber 73A with the drain passage 25A in the valve chamber 73. The relief valve 70 has a first spring 75A (first urging means) urging the main valve 71 to a side of the first valve chamber 73A so as to set the main valve 71 to a close position of the first relief passage 74A.

(b) The relief valve 70 has second relief passages 74B and 74C communicating the second valve chamber 73B with the drain passage 25A in the main valve 71. The relief valve 70 has a pilot valve 72 opening and dosing the second relief passages 74B and 74C so as to allow only the flow of the fluid from the second valve chamber 73B to the drain passage 25A within the second relief passages 74B and 74C. A second spring 75B (second urging means) sets the pilot valve 72 to a close position (a valve seat 76A) of the second relief passages 74B and 74C in accordance with a relief set pressure, and a valve holder 75C within the main valve 71.

(c) The relief valve 70 is structured such that when the fluid pressure in the pump discharge side becomes excessive due to a continuous static turn steering state generated by the power steering apparatus in which the pump 10 is used, or the like, and the fluid pressure of the second valve chamber 73B connected to the discharge passage in the downstream side of the metering orifice 46 reaches the relief set pressure, the fluid pressure of the second valve chamber 73B opens the pilot valve 72 against the second spring 75B. It is possible to relieve the fluid pressure in the second valve chamber 73B from the second relief passages 74B and 74C to the drain passage 25A so as to open the main valve 71 against the first spring 75A due to the fluid pressure of the first valve chamber 73A under the condition that the fluid pressure of the second value chamber 73B is reduced by this relief. It is possible to relieve the fluid pressure of the first valve chamber 73A from the first relief passage 74A to the drain passage 25A. Therefore, it is possible to relieve the excessive fluid pressure in the pump discharge side.

In accordance with the relief valve 70 shown in FIG. 5, the relief valve 70 is arranged in parallel to the switch valve 53 to control the movement of the cam ring 22. The relieving operation of the relief valve 70 does not directly influence the switching operation of the switch valve 53, and it is therefore possible to stably control the movement of the cam ring 22 by means of the switch valve 53.

In accordance with the present embodiment, the following operations can be obtained.

(1) The relief valve 70 placed in the pump discharge side passage is set to the pilot-drive type. In this relief valve 70, a change of the relief pressure due to the passing flow amount (a pressure override characteristic) is small. It is therefore possible to set a stable relief pressure even when the passing flow amount is changed in accordance with the change of the using conditions (a rotational speed and an oil temperature).

(2) The throttle 130 is provided in the passage applying the fluid pressure to the pilot valve 72 constituting the relief valve 70. Accordingly, it is possible to avoid a rapid pressure change of the fluid pressure applied to the pilot valve 72 so as to prevent a chattering, and it is possible to prevent a sound and a vibration in the relief valve 70.

Figure 6:
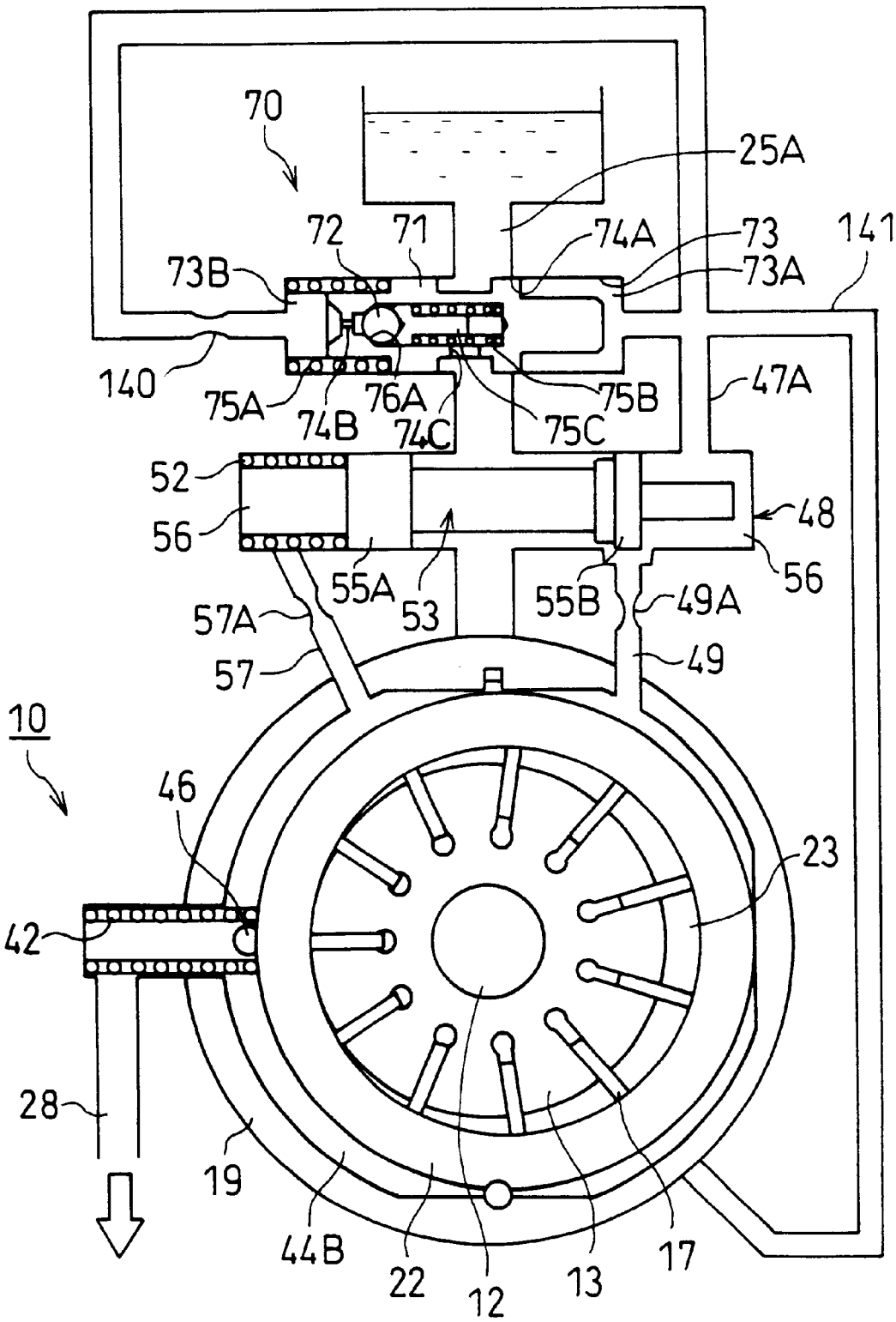
FIG. 6 is a hydraulic circuit view showing another embodiment of the variable displacement pump.

Second Embodiment FIG. 6

The second embodiment is different from the first embodiment when the fluid pressure in the upstream side of the metering orifice 46 in the pump discharge side passage is applied to the first valve chamber 73A and the second valve chamber 73B in the relief valve 70.

The relief valve 70 as shown in FIG. 6 is structured in a pilot-drive type in which a pilot valve 72 is added to a main valve 71. The main valve 71 can open and close an upstream side passage of the metering orifice 46 provided in the pump discharge side passage, that is, a first valve chamber 73A with respect to the drain passage 25A. A fluid pressure in the upstream side of the metering orifice 46 provided in the pump discharge side passage, and further a fluid pressure of the second valve chamber 73B is applied to the pilot valve 72. At this time, the fluid pressure in the upstream side of the metering orifice 46 is applied to the pilot valve 72 via a throttle 140. Then, the relief valve 70 shown in FIG. 6 has the following structures (a) to (c).

(a) The relief valve 70 has the main valve 71 slidably within the valve chamber 73, and applies the fluid pressure in the upstream side of the metering orifice 46 provided in the discharge side passage of the pump 10 to the first valve chamber 73A. The first valve chamber 73A is defined in one end side of the valve chamber 73 with respect to the main valve 71 via a passage 141. The relief valve 70 applies the fluid pressure in the upstream side of the metering orifice 46 to the second valve chamber 73B defined in another end side of the valve chamber 73 with respect to the main valve 71 via the passage 141 (the throttle 140). The relief valve 70 has a first relief passage 74A communicating the first valve chamber 73A with the drain passage 25A in the valve chamber 73. The relief valve 70 has a first spring 75A (first urging means) urging the main valve 71 to a side of the first valve chamber 73A so as to set the main valve 71 to a close position of the first relief passage 74A.

(b) The relief valve 70 has second relief passages 74B and 74C communicating the second valve chamber 73B with the drain passage 25A in the main valve 71. The relief valve 70 has a pilot valve 72 opening and closing the second relief passages 74B and 74C so as to allow only the flow of the fluid from the second valve chamber 73B to the drain passage 25A within the second relief passages 74B and 74C. A second spring 75B (second urging means) sets the pilot valve 72 to a close position (a valve seat 76A) of the second relief passages 74B and 74C in accordance with a relief set pressure, and a valve holder 75C within the main valve 71.

(c) The relief valve 70 is structured such that when the fluid pressure in the pump discharge side becomes excessive due to a continuous static turn steering state generated by the power steering apparatus in which the pump 10 is used, or the like, and the fluid pressure of the second valve chamber 73B connected to the discharge passage in the upstream side of the metering orifice 46 reaches the relief set pressure and the fluid pressure of the second valve chamber 73B opens the pilot valve 72 against the second spring 75B. It is possible to relieve the fluid pressure of the second valve chamber 73B from the second relief passages 74B and 74C to the drain passage 25A so as to open the main valve 71 against the first spring 75A due to the fluid pressure of the first valve chamber 73A under the condition that the fluid pressure of the second valve chamber 73B is reduced by this relief. It is possible to relieve the fluid pressure of the first valve chamber 73A from the first relief passage 74A to the drain passage 25A. It is therefore possible to relieve the excessive fluid pressure in the pump discharge side.

In accordance with the relief valve 70 shown in FIG. 6, the relief valve 70 is arranged in parallel to the switch valve 53 to control the movement of the cam ring 22. The relieving operation of the relief valve 70 does not directly influence the switching operation of the switch valve 53. It is therefore possible to stably control the movement of the cam ring 22 by means of the switch valve 53.

In accordance with the present embodiment, the following operations can be obtained.

(1) The relief valve 70 placed in the pump discharge side passage is set to the pilot-drive type. In this relief valve 70, a change of the relief pressure due to the passing flow amount (a pressure override characteristic) is small. It is therefore possible to set a stable relief pressure even when the passing flow amount is changed in accordance with the change of the using conditions (a rotational speed and an oil temperature).

(2) The throttle 140 is provided in the passage applying the fluid pressure to the pilot valve 72 constituting the relief valve 70. Accordingly, it is possible to avoid a rapid pressure change of the fluid pressure applied to the pilot valve 72 so as to prevent a chattering, and it is possible to prevent a sound and a vibration in the relief valve 70.

As heretofore explained, embodiments of the present invention have been described in detail with reference to the drawings. However, the specific configurations of the present invention are not limited to the embodiments but those having a modification of the design within the range of the present invention are also included in the present invention.

In accordance with the present invention, in the variable displacement pump, it is possible to set the stable relief pressure even when the using conditions (the rotational speed and the oil temperature) are changed when relieving the excessive fluid pressure in the pump discharge side.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A variable displacement pump comprising:

a rotor fixable to a pump shaft inserted to a pump casing and receiving a plurality vanes in a groove so as to be movable in a radial direction, the rotor being rotatable and drivable;

an adapter ring fitted to a fitting hole in the pump casing;

a cam ring fitted to the adapter ring so as to form a pump chamber between the cam ring and an outer peripheral portion of the rotor, being movable and displaceable within the adapter ring and separately forming first and second fluid pressure chambers between the cam ring and the adapter ring;

a switch valve operated due to a pressure difference between an upstream side and a downstream side in a metering orifice provided in a pump discharge side passage, and controlling the amount of fluid pressure supplied to the first and second fluid pressure chambers in correspondence to a discharge flow amount of a pressurized fluid discharged the pump chamber so as to move the cam ring and change a capacity of the pump chamber, thereby making it possible to control the discharge flow amount discharged from the pump chamber; and a relief valve relieving excessive fluid pressure in the pump discharge side, wherein the switch valve and the relief valve are provided separately, said relief valve is constituted by a pilot drive type relief valve comprising a pilot valve to a main valve, the fluid pressure in the downstream side of the metering orifice provided in the pump discharge side passage is applied to the pilot valve, and the main valve is capable of opening and closing the downstream side passage of the metering orifice with respect to a drain passage.

2. A variable displacement pump as claimed in claim 1, wherein the fluid pressure in the downstream side of the metering orifice provided in said pump discharge side passage is applied to the pilot valve via a throttle.

3. A variable displacement pump as claimed in claim 2, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and dosing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

4. A variable displacement pump as claimed in claim 1, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve has a second relief passage communicating the second valve chamber with the drain passage which is provided in the main valve, a pilot valve opening and closing said second relief passage so as to allow only a flow of the fluid from the second valve chamber to the drain passage provided within said second relief passage, and second urging means setting said pilot valve to a close position of the second relief passage in accordance with a relief set pressure, and a valve holder are provided within the main valve.

5. A variable displacement pump comprising:

a rotor fixable to a pump shaft inserted to a pump casing and receiving a plurality of vanes in a groove so as to be movable in a radial direction, the rotor being rotatable and drivable;

an adapter ring fitted to a fitting hole in the pump casing;

a cam ring fitted to the adapter ring so as to form a pump chamber between the cam ring and an outer peripheral portion of the rotor, being movable and displaceable within the adapter ring and separately forming first and second fluid pressure chambers between the cam ring and the adapter ring;

a switch valve operated due to a pressure difference between an upstream side and a downstream side in a metering orifice provided in a pump discharge side passage, and controlling the amount of fluid pressure supplied to the first and second fluid pressure chambers in correspondence to a discharge flow amount of a pressurized fluid discharged from the pump chamber so as to move the cam ring and change a capacity of the pump chamber, thereby making it possible to control the discharge flow amount discharged from the pump chamber; and a relief valve relieving excessive fluid pressure in the pump discharge side, wherein the switch valve and the relief valve are provided separately, said relief valve is constituted by a pilot drive type relief valve comprising a pilot valve to a main valve, the fluid pressure in the upstream side of the metering orifice provided in the pump discharge side passage is applied to the pilot valve, and the main valve is capable of opening and closing the upstream side passage of the metering orifice with respect to a drain passage.

6. A variable displacement pump as claimed in claim 5, wherein the fluid pressure in the upstream side of the metering orifice provided in said pump discharge side passage is applied to the pilot valve via a throttle.

7. A variable displacement pump as claimed in claim 6, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a dose position of the first relief passage, and wherein said relief valve is structured such that a second relief passage communicating the second valve chamber with the drain passage is provided in the main valve, a pilot valve opening and dosing said second relief passage so as to allow only a flow of the fluid from the second valve chamber to the drain passage is provided within said second relief passage, and second urging means setting said pilot valve to a dose position of the second relief passage in accordance with a relief set pressure, and a valve holder are provided within the main valve.

8. A variable displacement pump as claimed in claim 5, wherein said relief valve is structured such that a main valve is slidably disposed within a valve chamber, a first valve chamber is defined in one end side of the valve chamber with respect to the main valve, fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and closing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

9. A variable displacement pump comprising:

a rotor fixable to a pump shaft inserted to a pump casing and receiving a plurality vanes in a groove so as to be movable in a radial direction, the rotor being rotatable and drivable;

an adapter ring fitted to a fitting hole in the pump casing;

a cam ring fitted to the adapter ring so as to form a pump chamber between the cam ring and an outer peripheral portion of the rotor, being movable and displaceable within the adapter ring and separately forming first and second fluid pressure chambers between the cam ring and the adapter ring;

a metering orifice in communication with said second fluid chamber, a metering orifice spring biasing the cam ring in the direction of a maximum flow position, the cam ring being movable against the bias of the movable orifice spring under the influence of a biasing differential pressure between the first fluid pressure chamber and the second fluid pressure chamber, the cam ring being arranged and constructed to throttle the metering orifice as the biasing differential pressure moves the cam ring against an opposing force of the movable orifice spring, thereby controlling the discharge pressure of fluid delivered to a discharge passage, a switch valve operated due to a pressure difference between an upstream side and a downstream side in a metering orifice provided in a pump discharge side passage, and controlling the amount of fluid pressure supplied to the first and second fluid pressure chambers in correspondence to a discharge flow amount of a pressurized fluid discharged from the pump chamber so as to move the cam ring and change a capacity of the pump chamber, thereby making it possible to control the discharge flow amount discharged from the pump chamber; and a throttled region disposed in a communication channel between the switch valve and the first fluid pressure chamber, and a throttled region disposed in a communication channel between the switch valve and the second fluid pressure chamber, a relief valve relieving an excessive fluid pressure in the pump discharge side, wherein the switch valve and the relief valve are provided separately, said relief valve is constituted by a pilot drive type relief valve comprising a pilot valve to a main valve, the fluid pressure in the downstream side of the metering orifice provided in the pump discharge side passage is applied to the pilot valve, and the main valve is capable of opening and closing the downstream side passage of the metering orifice with respect to a drain passage.

10. A variable displacement pump as claimed in claim 9, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and closing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

11. A variable displacement pump as claimed in claim 9, wherein the fluid pressure in the downstream side of the metering orifice provided in said pump discharge side passage is applied to the pilot valve via a throttle.

12. A variable displacement pump as claimed in claim 11, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and closing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

13. A variable displacement pump comprising:

a rotor fixable to a pump shaft inserted to a pump casing and receiving a plurality vanes in a groove so as to be movable in a radial direction, the rotor being rotatable and drivable;

an adapter ring fitted to a fitting hole in the pump casing;

a cam ring fitted to the adapter ring so as to form a pump chamber between the cam ring and an outer peripheral portion of the rotor, being movable and displaceable within the adapter ring and separately forming first and second fluid pressure chambers between the cam ring and the adapter ring;

a metering orifice in communication with said second fluid chamber, a metering orifice spring biasing the cam ring in the direction of a maximum flow position, the cam ring being movable against the bias of the movable orifice spring under the influence of a biasing differential pressure between the first fluid pressure chamber and the second fluid pressure chamber, the cam ring being arranged and constructed to throttle the metering orifice as the biasing differential pressure moves the cam ring against an opposing force of the movable orifice spring, thereby controlling the discharge pressure of fluid delivered to a discharge passage, a switch valve operated due to a pressure difference between an upstream side and a downstream side in a metering orifice provided in a pump discharge side passage, and controlling the amount of fluid pressure supplied to the first and second fluid pressure chambers in correspondence to a discharge flow amount of a pressurized fluid discharged from the pump chamber so as to move the cam ring and change a capacity of the pump chamber, thereby making it possible to control the discharge flow amount discharged from the pump chamber; and a throttled region disposed in a communication channel between the switch valve and the first fluid pressure chamber, and a throttled region disposed in a communication channel between the switch valve and the second fluid pressure chamber, a relief valve relieving an excessive fluid pressure in the pump discharge side, wherein the switch valve and the relief valve are provided separately, said relief valve is constituted by a pilot drive type relief valve comprising a pilot valve to a main valve, the fluid pressure in the upstream side of the metering orifice provided in the pump discharge side passage is applied to the pilot valve, and the main valve is capable of opening and closing the upstream side passage of the metering orifice with respect to a drain passage.

14. A variable displacement pump as claimed in claim 13, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and closing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

15. A variable displacement pump as claimed in claim 13, wherein the fluid pressure in the upstream side of the metering orifice provided in said pump discharge side passage is applied to the pilot valve via a throttle.

16. A variable displacement pump as claimed in claim 15, wherein said relief valve is structured such that a main valve is slidably disposed within a valve chamber, a first valve chamber is defined in one end side of the valve chamber with respect to the main valve, a fluid pressure in the downstream side of said metering orifice is applied to said first valve chamber, a second valve chamber is defined in another end side with respect to said main valve, the fluid pressure in the downstream side of said metering orifice is also applied to said second valve chamber, a first relief passage communicating said first valve chamber with the drain passage is provided in the valve chamber, and first urging means urging the main valve to a side of the first valve chamber so as to set the main valve to a close position of the first relief passage, and wherein said relief valve is structured such that a second relief passage communicating the second valve chamber with the drain passage is provided in the main valve, a pilot valve opening and closing said second relief passage so as to allow only a flow of the fluid from the second valve chamber to the drain passage is provided within said second relief passage, and second urging means setting said pilot valve to a close position of the second relief passage in accordance with a relief set pressure, and a valve holder are provided within the main valve.

* * * * *

UNITED STATES PATENT AND TRADEMARK OFFICE

CERTIFICATE OF CORRECTION

PATENT NO. : 6,530,752 B2
DATED : March 11, 2003
INVENTOR(S) : Oba, Kenzo and Yoshida, Katsuyuki It is certified that error appears in the above-identified patent and that said Letters Patent is hereby corrected as shown below:

Column 10,
Line 31, “discharged the pump” should read -- discharged from the pump --.

Column 11,
Line 2, “dosing” should read -- closing --.

Column 12,
Line 26, “dosing” should read -- closing --.

Signed and Sealed this

Twelfth Day of August, 2003

JAMES E. ROGAN
*Director of the United States Patent and Trademark Office*